US008607683B1

(12) United States Patent
Burgermeister

(10) Patent No.: US 8,607,683 B1
(45) Date of Patent: Dec. 17, 2013

(54) ACTIVE AMMUNITION MAGAZINE

(75) Inventor: William Burgermeister, Freehold, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 102 days.

(21) Appl. No.: 13/413,187

(22) Filed: Mar. 6, 2012

(51) Int. Cl.
*F41A 9/31* (2006.01)

(52) U.S. Cl.
USPC ..... 89/33.16; 89/34

(58) Field of Classification Search
USPC ..... 89/34, 33.16, 33.17, 33.25
See application file for complete search history.

(56) References Cited

U.S. PATENT DOCUMENTS 3,230,828 A * 1/1966 Maillard ..... 89/33.25
4,481,858 A * 11/1984 Price ..... 89/11
4,681,019 A * 7/1987 Brandl et al. ..... 89/33.04

* cited by examiner

*Primary Examiner* — Stephen M Johnson
(74) *Attorney, Agent, or Firm* — Henry S. Goldfine

(57) ABSTRACT

An ammunition magazine for feeding linked ammunition to a weapon system having a power take off (PTO) may include a housing with a storage cavity for the linked ammunition. A drive shaft may be rotatably fixed to the housing and may include a driver on one end for selectively engaging the PTO. A drive sprocket may be mounted on the drive shaft for engaging and moving the linked ammunition in a feed direction. The drive sprocket may include first and second sprocket wheels that engage a cartridge portion of the linked ammunition. A pick-off round opening may be formed in the housing for presenting a pick-off round to the weapon system. A link chute may be disposed below the opening and including an exit for ammunition links.

22 Claims, 12 Drawing Sheets

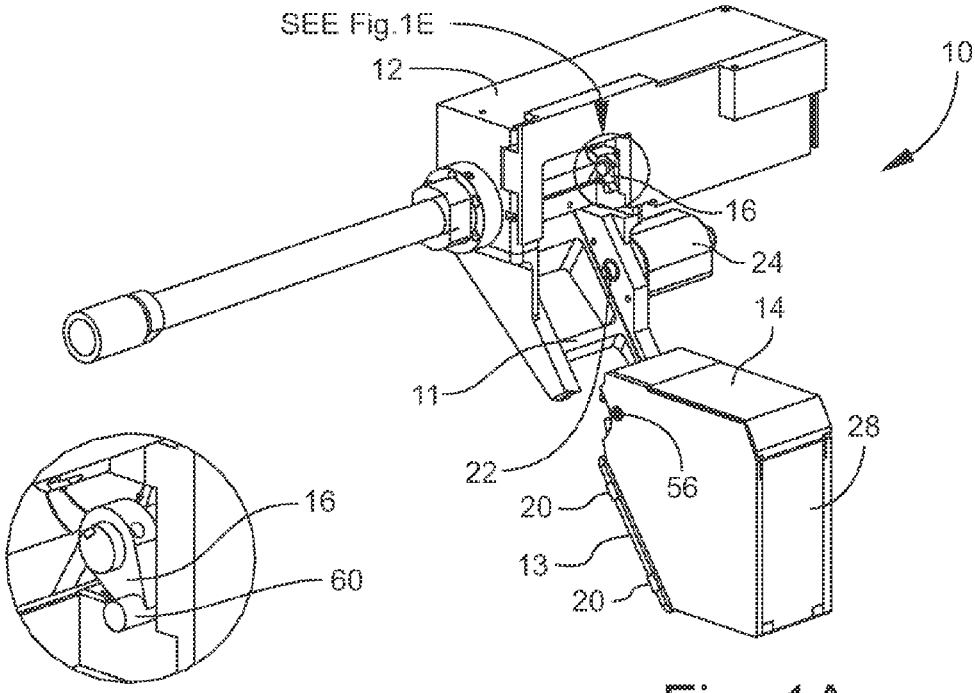
Fig. 1E
Fig. 1A
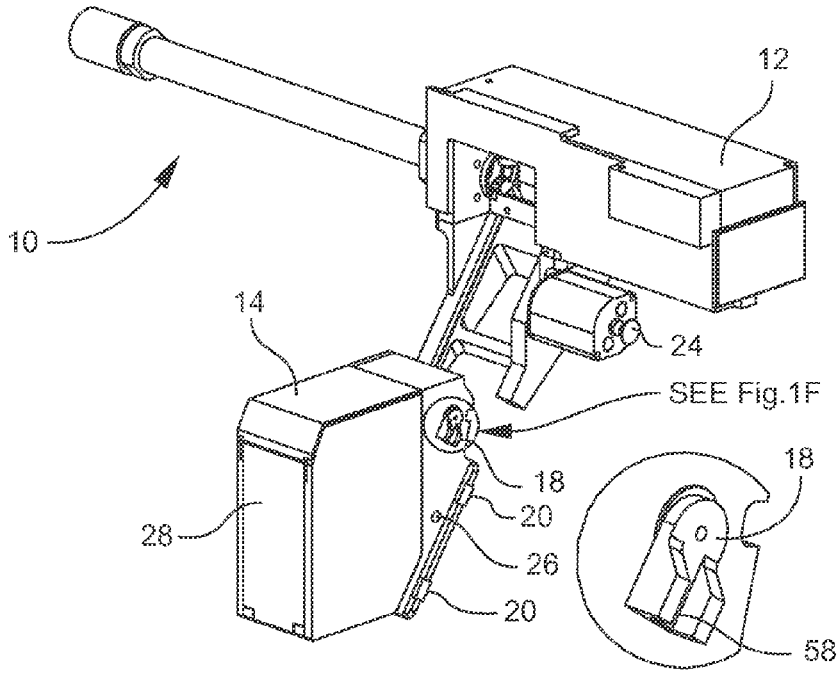
Fig. 1B
Fig. 1F

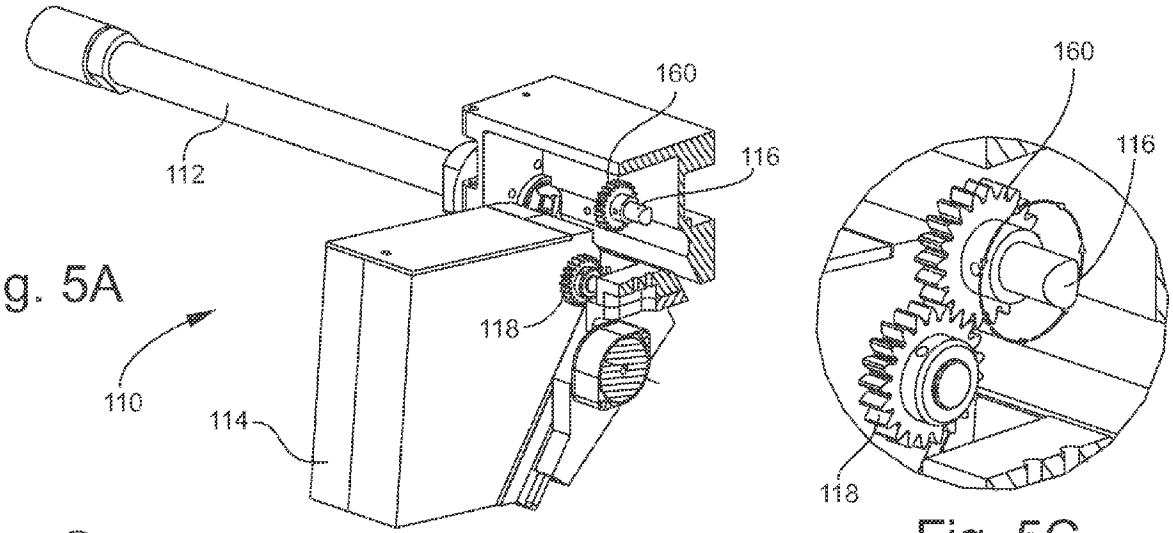
Fig. 5A
Fig. 5C
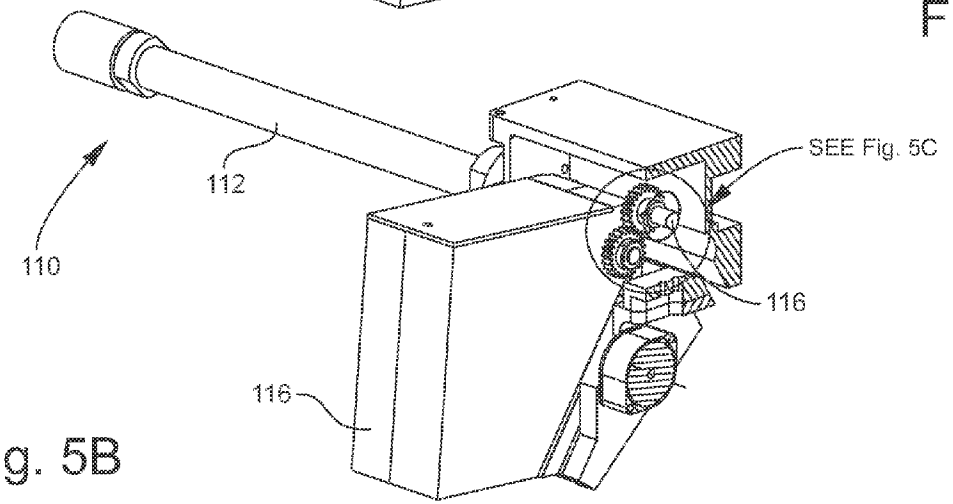
Fig. 5B

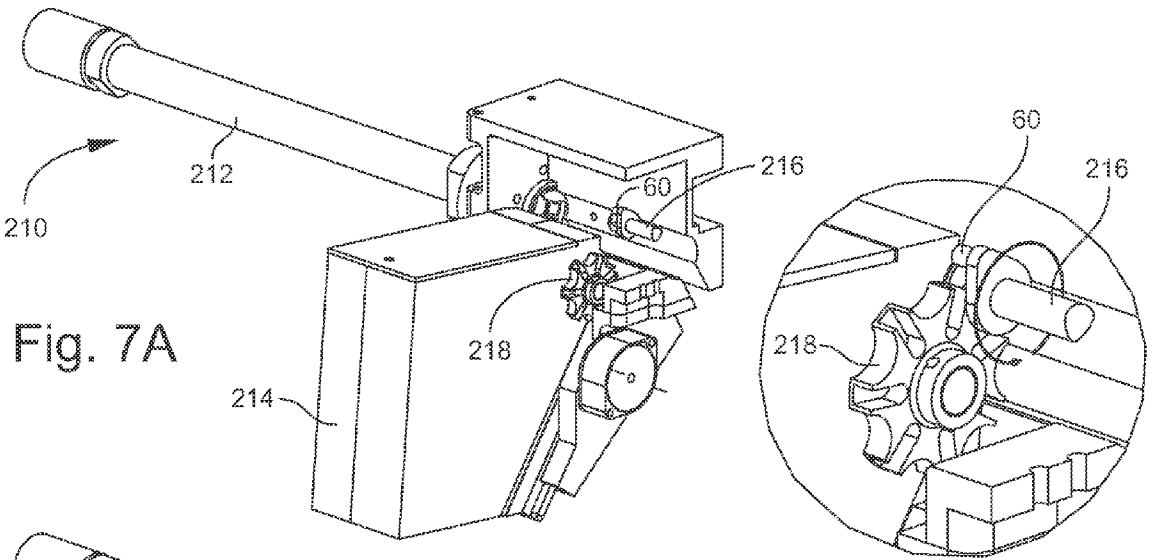
Fig. 7A
Fig. 7C
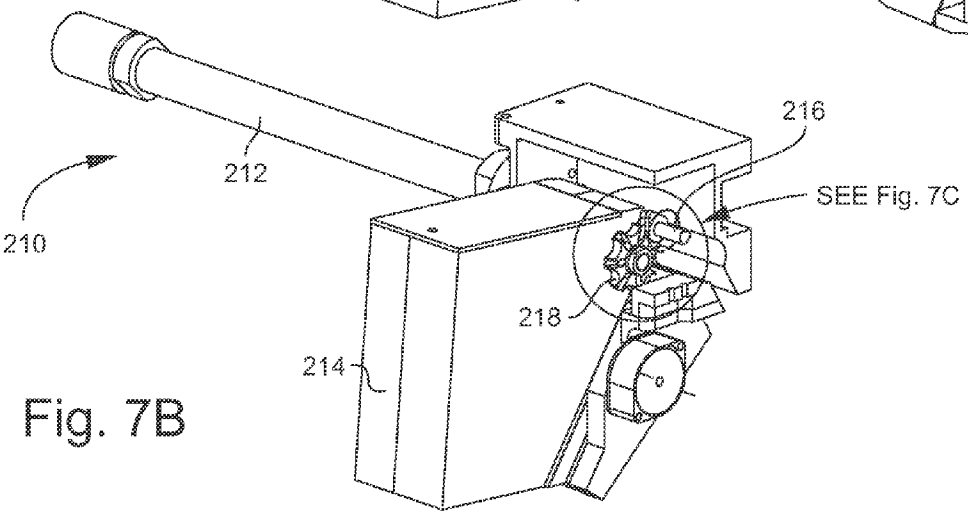
Fig. 7B

ACTIVE AMMUNITION MAGAZINE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to weapon system ammunition magazines and in particular to ammunition magazines for automatically loading and reloading weapons.

A problem with some firearms and crew-served weapons is the lack of integrated ammunition handling capabilities such as, for example, automated, or remotely-operated weapon reloading for manned or unmanned vehicle platforms or fixed emplacements such as buildings or towers. This problem has existed since the development of automatic weapons and linked ammunition. The problem has become greater with the recent development of and demand for Remote Weapon Systems (RWS), such as the Common-Remotely Operated Weapon Station (CROWS). For example, CROWS may have a supply of readily available ammunition, but reloading the depleted ammunition required human intervention at the weapon. Such human intervention increases the risk of injury or death and inherently defeats the purpose of fielding RWS and installing them on platforms/sites where human intervention for reloading is plainly not desirable.

There may be no known apparatus that can remotely and automatically load linked ammunition into weapon. One way of solving this problem may be to modify existing ammunition magazines, which are simple boxes for storage and transport. Known ammunition magazines would require extensive modifications to enable their use with automated ammunition handling systems and to facilitate the weapon loading processes. Known magazines would also require the addition of a complicated mechanism to interface the magazine to the weapon. And, modifying known magazines to provide precise and full control of the linked ammunition would compromise the realization of desired performance features, such as first-round select, partial magazine use, high reliability, full and accurate ammunition inventory, etc.

A long-felt and unsolved need exists for ammunition magazines that may be remotely and automatically loaded to and unloaded from a weapon while providing precise control of the ammunition position and ammunition feed for high/variable rate of fire.

SUMMARY OF THE INVENTION

It is an object of the invention to provide an ammunition magazine for linked ammunition that can be automatically loaded to and unloaded from a weapon.

One aspect of the invention is an ammunition magazine for feeding linked ammunition to a weapon system having a power take off (PTO). The ammunition magazine may include a housing that defines a storage cavity for the linked ammunition. A drive shaft may be rotatably fixed to the housing. The drive shaft may include a driver on one end for selectively engaging the PTO. The driver may be disposed external to the housing.

A drive sprocket may be mounted on the drive shaft for engaging and moving the linked ammunition in a feed direction. The drive sprocket may include first and second sprocket wheels that engage a cartridge portion of the linked ammunition. A back-ratchet may be pivotally mounted to the housing. The back-ratchet may selectively engage the drive sprocket to prevent movement of the drive sprocket in a direction opposite the feed direction. A pick-off round opening may be formed in the housing for presenting a pick-off round of the linked ammunition to the weapon system. A link chute may be disposed below the opening and include an exit opening for ammunition links.

The drive sprocket may include a third sprocket wheel that engages a link portion of the linked ammunition.

Indentations may be formed on opposing edges of an external surface of the housing. A retaining rod opening may be formed in one side of the housing.

The magazine may include a retainer disposed in the link chute for retaining empty ammunition links. The retainer may include a flap and a spring wherein the spring biases the flap into the link chute.

A pick-off round retainer may be disposed adjacent to the pick-off round opening. The pick-off round retainer may include a leaf spring having one end fixed to the housing and another end for engaging the pick-off round.

In some embodiments, the drive sprocket may be fixed to the drive shaft for rotation therewith. The drive sprocket may include a ratchet wheel. The back-ratchet may selectively engage the ratchet wheel to prevent movement of the drive sprocket in a direction opposite the feed direction. The back-ratchet may be biased towards the ratchet wheel.

In other embodiments, the drive sprocket may be rotatably mounted on the drive shaft. The drive sprocket may include a first ratchet plate fixed thereto. The magazine may further include a second ratchet plate translatably disposed on the drive shaft adjacent to the first ratchet plate. The second ratchet plate may be translatably biased towards the first ratchet plate and rotatable with the first ratchet plate in the feed direction. The first ratchet plate may not rotate with the second ratchet plate in the direction opposite the feed direction.

The second sprocket wheel may include first and second sets of teeth. The first set of teeth may extend radially further than the second set of teeth. The second set of teeth may selectively engage the back-ratchet. Teeth in the second set of teeth may include respective rounded surfaces and flat surfaces. The rounded surfaces may contact the back-ratchet when the drive shaft rotates in the feed direction. The flat surfaces may contact the back-ratchet when the drive shaft rotates in the direction opposite the feed direction.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIGS. 1A and 1B are perspective side views of one embodiment of an active ammunition magazine shown unloaded from a weapon and FIGS. 1C and 1D are perspective side views of the active magazine of FIGS. 1A and 1B shown loaded to the weapon.

FIG. 1E is an enlarged view of a portion of FIG. 1A.

FIG. 1F is an enlarged view of a portion of FIG. 1B.

FIG. 5A is a perspective sectional view of another embodiment of a weapon system with an ammunition magazine in a position prior to engagement with a power take off.

FIG. 5B shows the ammunition magazine of FIG. 5A after engagement with the power take off.

FIG. 5C is an enlarged view of a portion of FIG. 5B showing the engagement of the magazine driver with the power take off.

FIG. 7A is a perspective sectional view of another embodiment of a weapon system with an ammunition magazine in a position prior to engagement with a power take off.

FIG. 7B shows the ammunition magazine of FIG. 7A after engagement with the power take off.

FIG. 7C is an enlarged view of a portion of FIG. 7B showing the engagement of the magazine driver with the power take off.

DETAILED DESCRIPTION OF THE PREFERRED EMBODIMENTS

An active ammunition magazine may allow automated loading of stowed, linked ammunition to a weapon system. The weapon system may be configured in different calibers, for example, 7.62 mm, .50 calibers, etc. The rounds or cartridges may be linked together in a belt using known links. Using remote control, the active magazine may present stowed, linked ammunition to a weapon for firing. The active magazine may facilitate automated loading and unloading of linked ammunition to a weapon. The active magazine may enable storage of linked ammunition and enable remote loading and resupply. The active magazine may be locked to the weapon and, after actuation of the weapon, the magazine may precisely present ammunition to the weapon.

The design of the active magazine may decouple a total ammunition stowage mass from the weapon. Decoupling the ammunition stowage mass from the weapon decreases the total mass that is subject to aiming and stabilization performance. Because multiple active magazines may be automatically loaded and unloaded, each individual active magazine may not need to contain as many rounds as known magazines. Thus, the mass of a single active magazine may be less than the mass of a known magazine.

The active magazines may be loaded with different types of ammunition, thereby enhancing mission flexibility. The active magazines may be remotely stowed. The ability to stow and reload magazines remotely and automatically may enable much longer firing engagement times and may enable different types of firing engagements, without human intervention at the weapon to either reload or change the ammunition type.

The active magazine may include, among others, the following capabilities: (a) under armor resupply; (b) first round select; (c) partial magazine use; (d) high reliability; and (e) true robotic application.

FIGS. 1A-D show a weapon system 10 that may include a weapon 12 and an ammunition magazine 14. Magazine 14 may include a housing 28. Weapon system 10 may be, for example, a type of weapon system disclosed in pending U.S. patent application Ser. No. 12/622,355 filed on Nov. 19, 2009, entitled "Automatically-Reloadable, Remotely-Operated Weapon System having an Externally-Powered Firearm," and having the same assignee as the instant application. Weapon 12 may be, for example, a type of weapon disclosed in pending U.S. patent application Ser. No. 12/607,393 filed on Oct. 28, 2009, entitled "Reciprocally-Cycled, Externally-Actuated Weapon," and having the same assignee as the instant application. The afore-mentioned U.S. patent application Ser. Nos. 12/622,355 and 12/607,393 are expressly incorporated by reference herein.

Figure 1C:
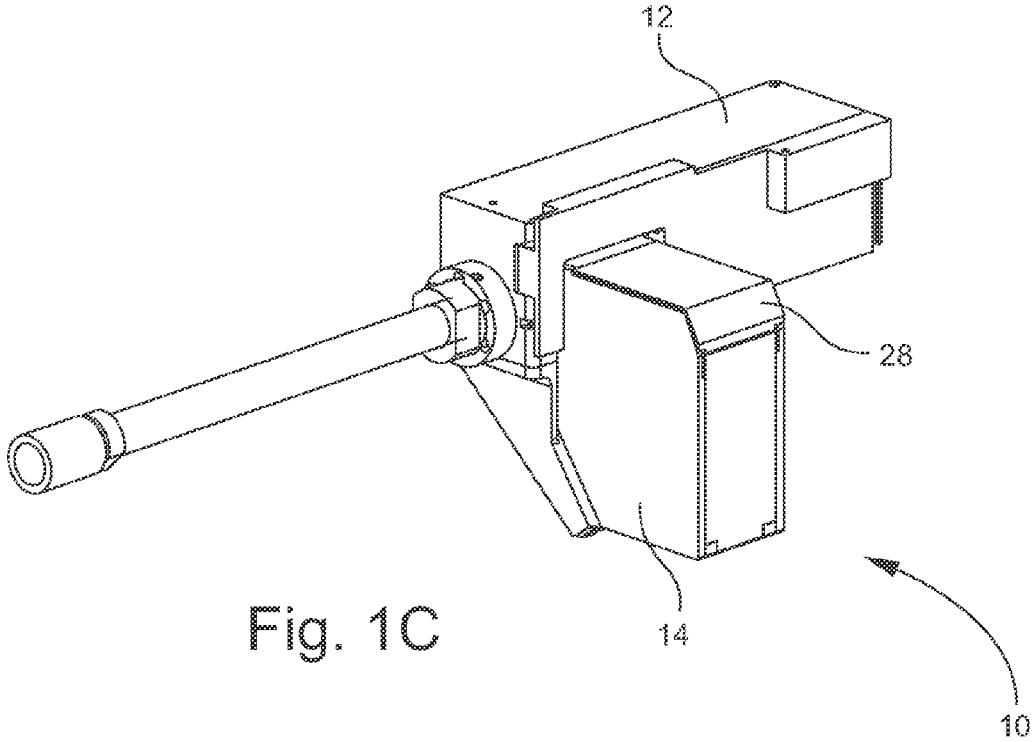

Magazine 14 may be remotely and automatically transported from an unloaded position, shown in FIGS. 1A and B, to a loaded position, shown in FIGS. 1C and D using, for example, a transport mechanism disclosed in U.S. patent application Ser. No. 12/622,355. Magazine 14 may be held in the loaded position on a track 11 by, for example, spring-loaded plungers (not shown) that engage indentations or notches 20 formed in opposing pairs on guide rails 13 of ammunition magazine 14, and/or by a cross pin 22 (FIG. 1A) that may be removably insertable in an opening 26 (FIG. 1B) in ammunition housing 28. A solenoid 24 may provide the means to translate cross-pin 22 into and out of opening 26. Other means may be used to secure magazine 14 in the loaded position.

Magazine 14 may include a driver 18 (FIG. 1B) disposed on an exterior of housing 28. One example of driver 18 is shown enlarged in FIG. 1F. Driver 18 may engage a power take off (PTO) 16 when magazine 14 is in the loaded position. One example of a PTO 16 is shown enlarged in FIG. 1E. PTO 16 may be driven directly by weapon 12, or may be driven by a separate power supply, such as, for example, an electric motor.

Referring to FIGS. 2A-F, housing 28 of magazine 14 may define a storage cavity 34 for linked or belted ammunition. The linked ammunition may include a plurality of cartridges or rounds 32, 33 (cartridge or round 32 is the "pick-off" round) linked together with known belt links 36. Three rounds and five links 36 (two empty, three with rounds) are shown in FIGS. 2C-F, however, the number of linked rounds is only constrained by the capacity of storage cavity 34. The dashed line B in FIG. 2C indicates a feed path of an ammunition belt containing a plurality of rounds and links 36.

Figure 1D:
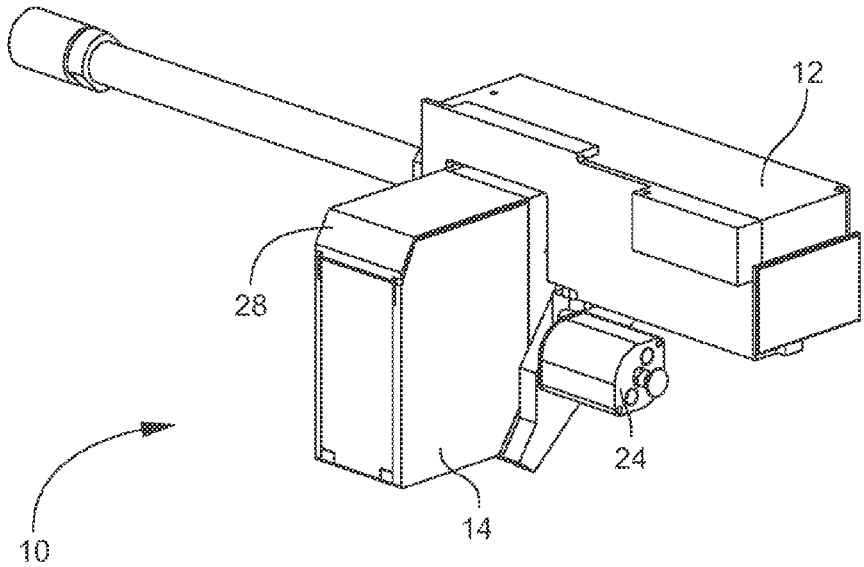

Housing 28 may include a pick-off round opening 30 formed therein for presenting a pick-off round 32 to weapon 12. Pick-off round 32 may be positioned in magazine 14 so that weapon 12 may extract it from magazine 14 when magazine 14 and weapon 12 are connected (FIGS. 1C-D). Pick-off round 32 may be pushed forward through magazine 14 as shown by the arrow A in FIG. 2A. A link chute 40 may be disposed below pick-off round opening 30 for guiding empty links 36 away from pick-off round opening 30. Housing 28 may include a link chute exit opening 42 for disposing of links 36 in link chute 40.

Figure 2A:
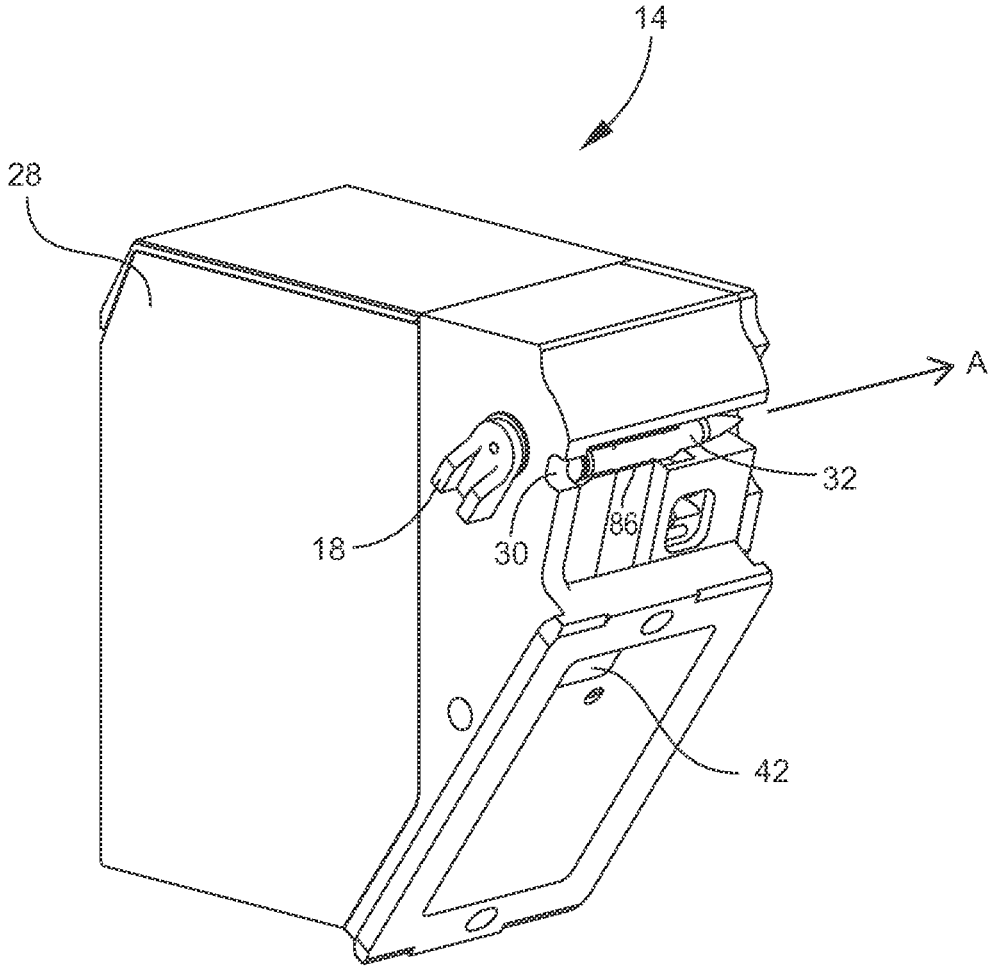
FIG. 2A is a perspective view of the active magazine of FIGS. 1A-D.
Figure 2C:
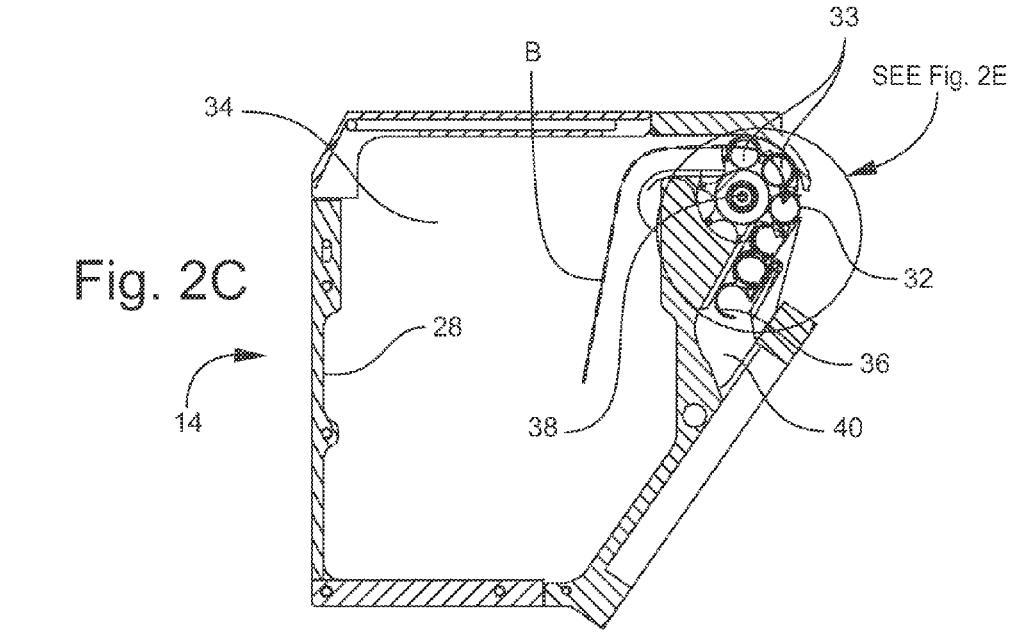
FIG. 2C is a sectional view taken along the line 2C-2C of FIG. 2B.
Figure 2B:
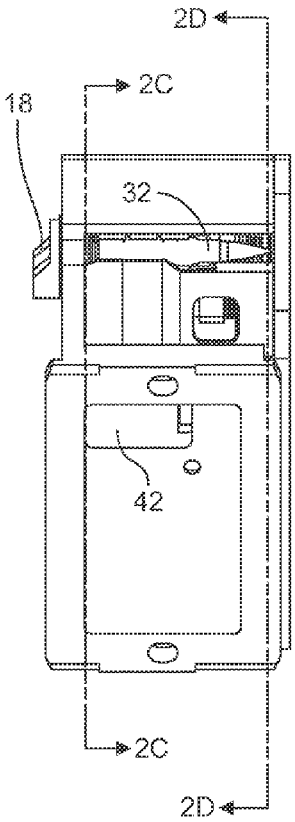
FIG. 2B is a front view of the magazine of FIG. 2A.
Figure 2D:
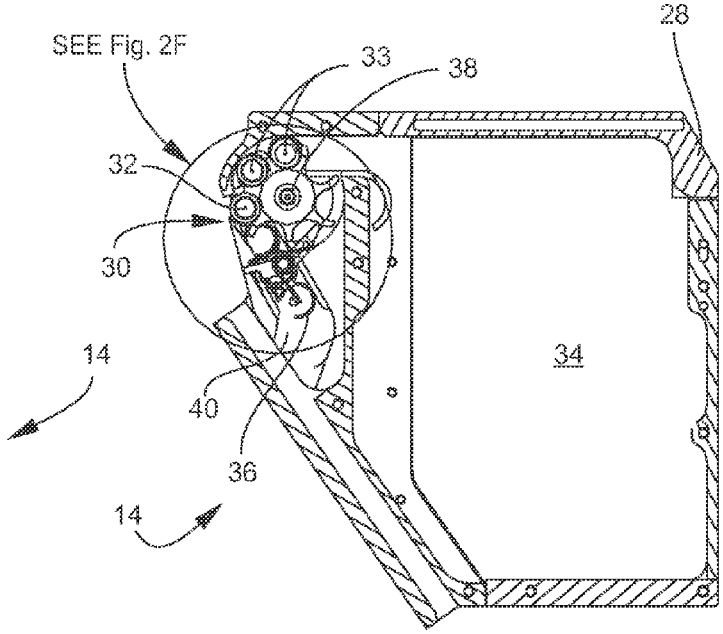
FIG. 2D is a sectional view taken along the line 2D-2D of FIG. 2B.
Figure 2E:
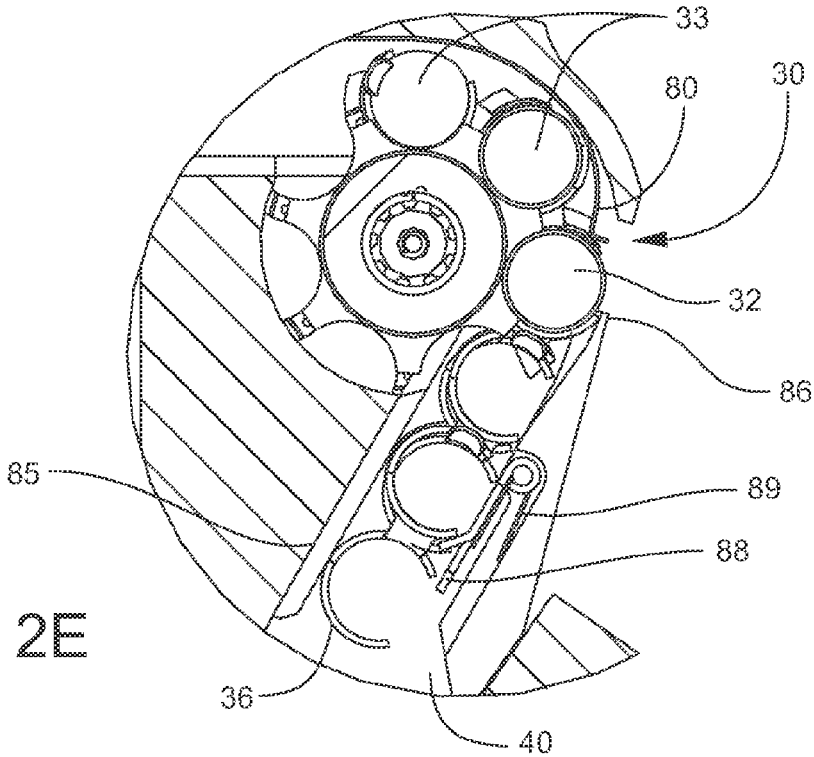
FIG. 2E is an enlarged view of a portion of FIG. 2C.
Figure 2F:
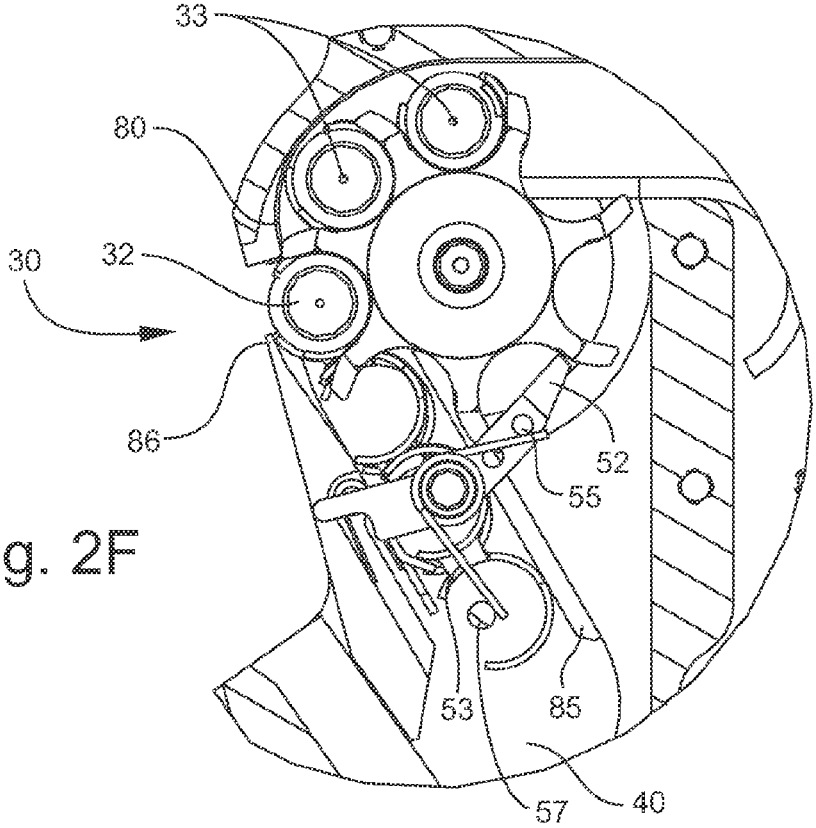
FIG. 2F is an enlarged view of a portion of FIG. 2D.

To help maintain the correct position of pick-off round 32, magazine 14 may include a pick-off round retainer in the form of one or more leaf springs 80 (FIGS. 2E-F). Leaf springs 80 may have one end 82 (See FIG. 3D) fixed to housing 28 and another end 84 for contacting pick-off round 32. Magazine 14 may include another retainer for pick-off round 32 in the form of a lip 86 (FIGS. 2E-F) formed at a bottom of pick-off round opening 30.

Pick-off round 32 may be pushed in a forward direction (arrow A in FIG. 2A) out of its link 36 by an extraction mechanism (not shown) in weapon 12. After pushing out pick-off round 32, the extraction mechanism may need to return to its original position. In this regard, it may be important that the empty link 36 in pick-off round opening 30 not move until the extraction mechanism has finished its return stroke and cleared pick-off round opening 30. Lip 86 and leaf springs 80 may help maintain the position of empty link 36 in pick-off round opening 30.

Figure 3A:
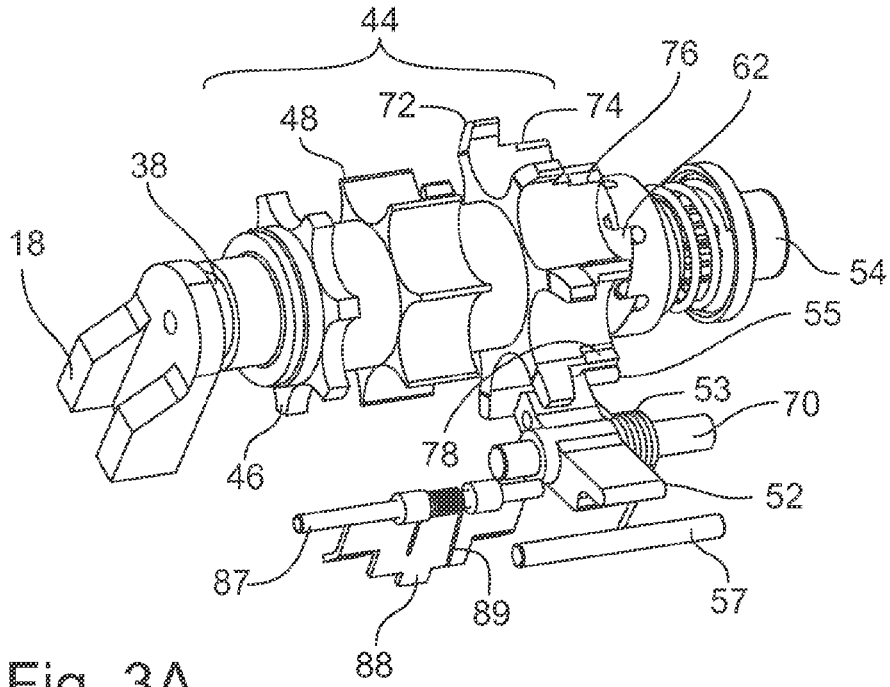
FIG. 3A is a perspective view of the drive components of the active magazine of FIGS. 1A-D, without the magazine housing.
Figure 3B:
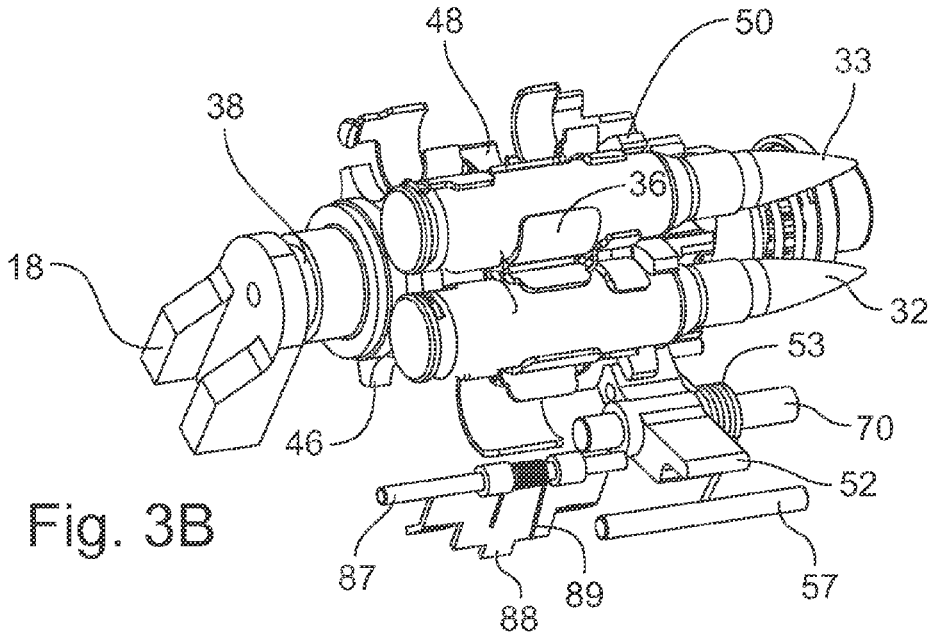
FIG. 3B shows the drive components of FIG. 3A with two linked rounds.
Figure 3C:
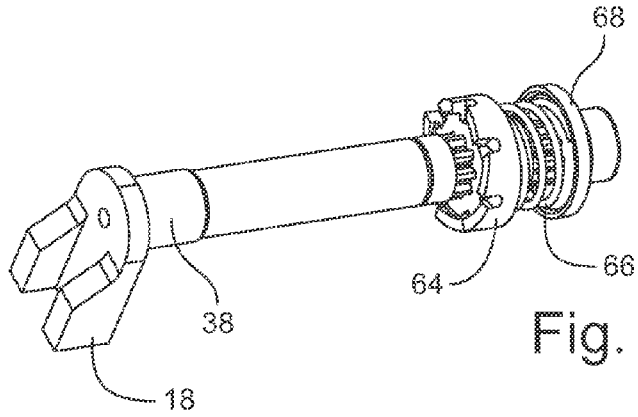
FIG. 3C illustrates the structure of a translatably biased ratchet plate.
Figure 3D:
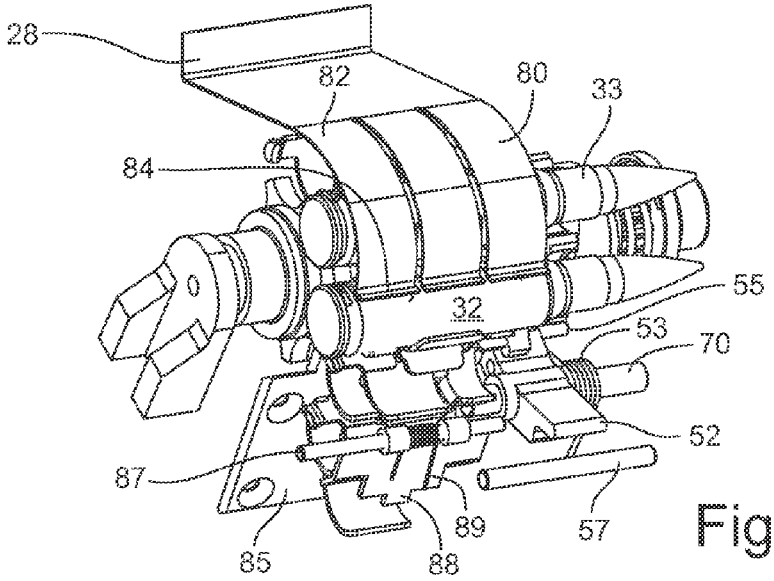
FIG. 3D shows a pick-off round retainer.
Figure 3E:
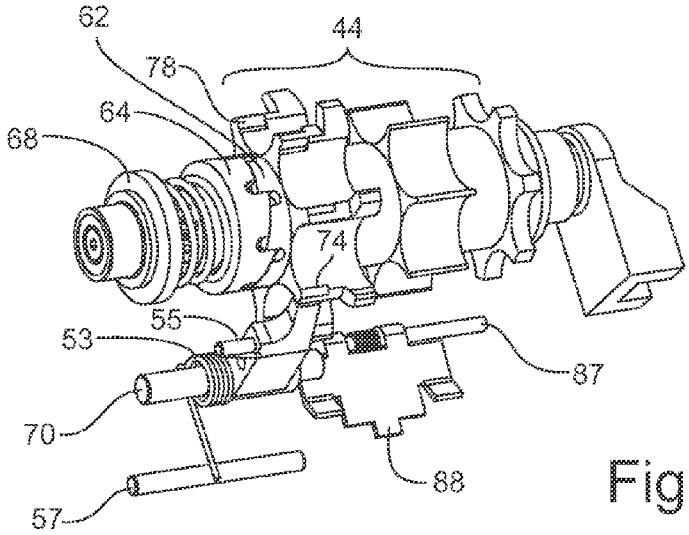
FIG. 3E is an opposite side view of FIG. 3A.

But, empty link 36 may, by the force of gravity, move downward into link chute 40. To prevent this from happening, a link chute flap 88 (FIG. 2E and FIGS. 3A, B, D and E) may be rotatable into chute 40. Flap 88 may be pivotally mounted on a shaft 87 (FIGS. 3A, B, D, and E). A spring 89 may bias flap 88 into the link chute 40. Flap 88 may function to hold a column of empty links 36 in chute 40, thereby providing support for the empty link 36 in pick-off round opening 30. As shown in FIG. 3D, flap 88 may bias empty links 36 against a portion 85 of housing 28.

In FIGS. 2C-F, two empty links 36 are shown in link chute 40. When the next round 33 moves into pick-off round opening 30, the bottom empty link 36 will fall downward into chute 40 and out exit opening 42. Flap 88 will spring back and support the remaining empty links 36 in chute 40.

Figures 4A, 4B, 4C:
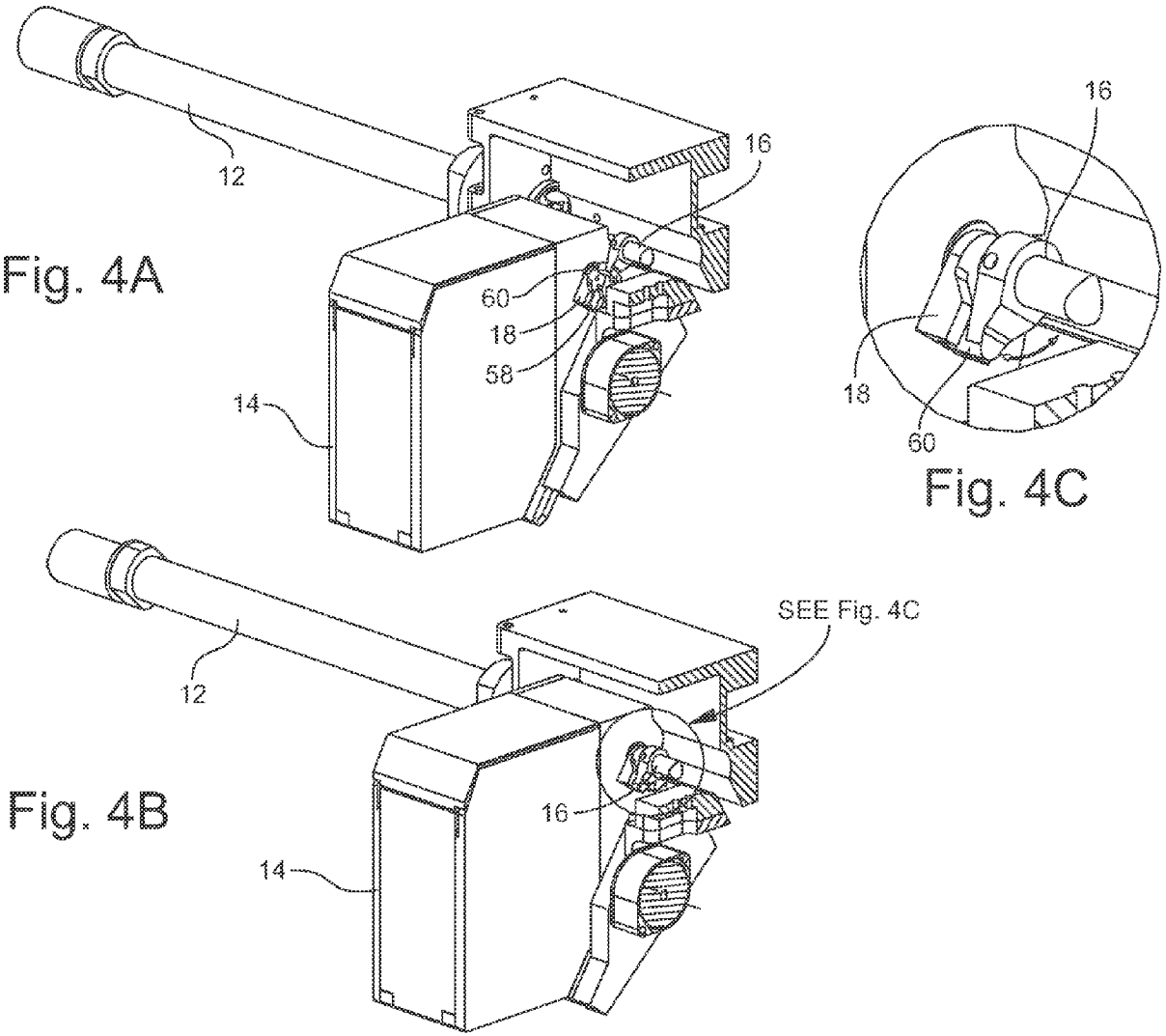
FIG. 4A is a perspective sectional view of an ammunition magazine in a position prior to engagement with a power take off.
FIG. 4B shows the ammunition magazine of FIG. 4A after engagement with the power take off.
FIG. 4C is an enlarged view of a portion of FIG. 4B showing the engagement of the magazine driver with the power take off.

Driver 18 may provide an oscillating rotary motion to drive shaft 38. As shown in FIG. 1F, driver 18 may be in the form of a generally U-shaped hub defining a slot 58 therein. PTO 16 (FIGS. 1A and E) may have a coupling in the form of a pin 60 for insertion in slot 58. Pin 60 may move in an oscillating rotary motion. FIG. 4A is a perspective sectional view of ammunition magazine 14 in a position prior to engagement with PTO 16. In FIG. 4A, magazine 14 may be moving upward toward weapon 12. Pin 60 of PTO 16 is positioned to be inserted in slot 58 of driver 18. In FIG. 4B, magazine 14 is in its loaded position and pin 60 of PTO 16 is disposed in slot 58 of driver 18. As shown by the arrow in the enlarged view of FIG. 4C, PTO 16 and pin 60 may oscillate. The oscillating motion of pin 60 is transferred to driver 18 and drive shaft 38. As will be explained below, other types of input motion may be used for driver 18. The oscillating rotary motion of PTO 16 and pin 60 is one example of input motion to magazine 14.

Driver 18 may be fixed to one end of a drive shaft 38 (FIGS. 2E-F) that passes through housing 28. Drive shaft 38 may be rotatably fixed to housing 28. FIG. 3A is a perspective view of the drive components of magazine 14, without magazine housing 28. An end 54 of drive shaft 38 opposite driver 18 may be rotatably disposed in an opening 56 (FIG. 1A) in a side of housing 28. A drive sprocket 44 may be mounted on drive shaft 38 for engaging and moving linked ammunition in the feed direction. In the embodiment of FIG. 3A, drive sprocket 44 may be rotatably mounted on drive shaft 38. Drive sprocket 44 may include one or more sprocket wheels 46, 48 and 50. As shown in FIG. 3B, sprocket wheels 46 and 50 may engage the cartridges or rounds 32, 33. Sprocket wheel 48 may engage links 36 on rounds 32.

The oscillating rotary motion of driver 18 may be transformed into an intermittent, one-way rotary motion for drive sprocket 44 using the components shown in FIGS. 3A-E. Driver 18 may be fixed to drive shaft 38. Drive sprocket 44 may rotate with respect to drive shaft 38. One end of drive sprocket 44 may include a ratchet plate 62 that rotates with drive sprocket 44. Another ratchet plate 64 may be mounted on drive shaft 38 adjacent to ratchet plate 62. Ratchet plate 64 may be fixed for rotation with drive shaft 38 using, for example, a splined connection. Ratchet plate 64 may be translatable on drive shaft 38. Ratchet plate 64 may be translatably biased toward ratchet plate 62 using, for example, a spring 66. Spring 66 may extend between ratchet plate 64 and a spring stop 68. Spring stop 68 may be fixed to drive shaft 38. In FIGS. 3A-D, the feed direction is clockwise rotation of drive shaft 38 when viewed from the driver 18 end of drive shaft 38. During rotation of drive shaft 38 in the feed direction, ratchet plate 64 engages and rotates with ratchet plate 62.

When driver 18 rotates in the counter-feed direction, back ratchet 52 may engage drive sprocket 44 to prevent rotation of drive sprocket 44 in the counter-feed direction. Ratchet plate 64 may disengage from ratchet plate 62 and ratchet plate 64 may rotate in the counter-feed direction. When driver 14 changes direction of rotation back to the feed direction, spring 66 may force ratchet plate 64 into rotational engagement with ratchet plate 62.

Back-ratchet 52 may be pivotally mounted on a shaft 70 which is fixed to housing 28. Back-ratchet 52 may selectively engage drive sprocket 44 to prevent movement of drive sprocket 44 in the counter-feed direction. A torsion spring 53 may be mounted on shaft 70 to bias back-ratchet 52 toward drive sprocket 44. A pair of torsion spring stops 55, 57 may be included for torsion spring 53 (see also FIG. 2F). Stop 57 may be in the form of a shaft or rod that is fixed to housing 28. Stop 55 (best seen in FIGS. 3E and 2F) may be in the form of a projection extending from back-ratchet 52.

Sprocket wheel 50 may include first and second sets of teeth 72, 74. Teeth 72 may extend radially further than teeth 74. Teeth 74 may be used to selectively engage back-ratchet 52. To this end, each tooth 74 may include a rounded surface 76 and a flat surface 78. Rounded surfaces 76 may contact back-ratchet 52 when drive shaft 38 rotates in the feed direction. Flat surfaces 78 may contact back-ratchet 52 when drive shaft 38 rotates in the counter-feed direction.

FIG. 5A is a perspective sectional view of another embodiment of a weapon system 110 with an ammunition magazine 114 in a position prior to engagement with a power take off 116 of a weapon 112. In this embodiment, the PTO coupling may be in the form of a toothed gear 160 and the magazine driver may be a toothed gear 118. FIG. 5B shows the ammunition magazine 114 of FIG. 5A after engagement of gears 160, 118. FIG. 5C is an enlarged view of a portion of FIG. 5B showing the engagement of gears 160, 118. PTO gear 160 may provide rotary motion in a single direction as shown by the arrows in FIG. 5C. The rotary motion of PTO gear 160 may include an intermittent dwell. The intermittent rotary motion of PTO gear 160 may be transferred to magazine driver gear 118.

Figure 6A:
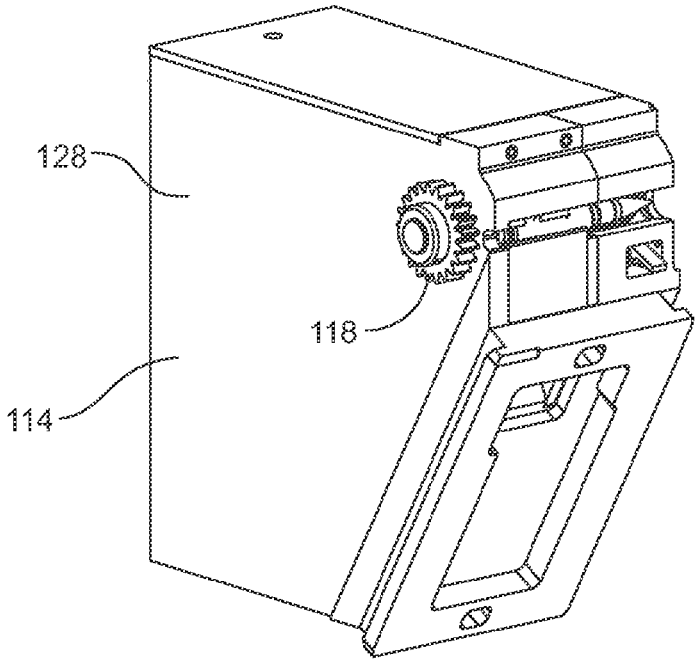
FIG. 6A is a perspective view of the magazine of FIG. 5A.
Figure 6B:
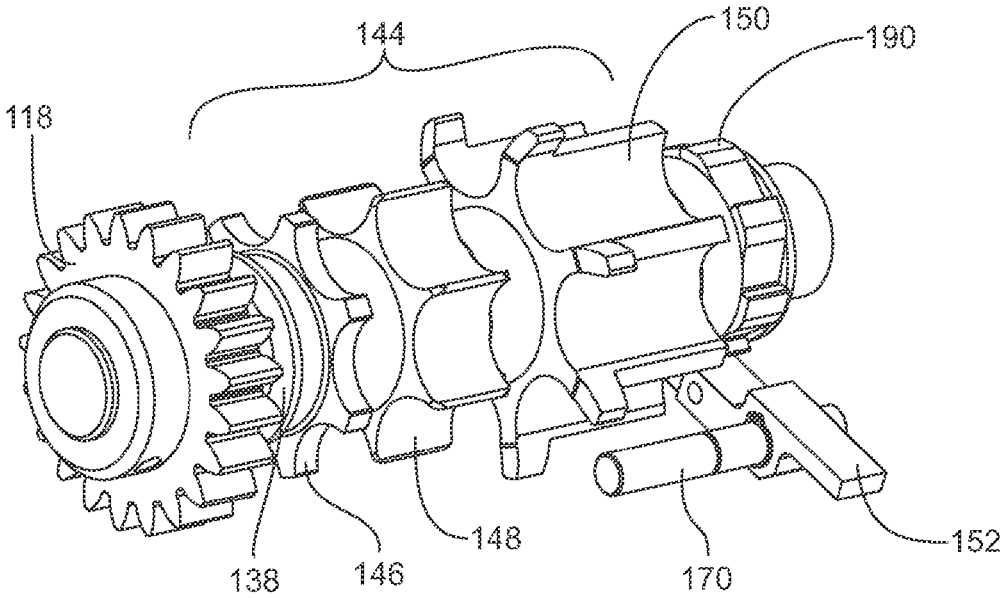
FIG. 6B is an enlarged view of the drive components of the magazine of FIG. 6A.

FIG. 6A is a perspective view of magazine 114 of FIG. 5A. FIG. 6B is an enlarged view of the drive components of magazine 114. Driver gear 118 may be fixed to a drive shaft 138. A drive sprocket 144 may be fixed to drive shaft 138 for rotation therewith. Drive sprocket 144 may include sprocket wheels 146, 148 and 150. Sprocket wheels 146 and 150 may contact the cartridges or rounds 32. Sprocket wheel 148 may contact links 36. A ratchet wheel 190 may be fixed on drive shaft 138 for rotation therewith. A back-ratchet 152 may selectively engage ratchet wheel 190 to prevent rotation of drive shaft 138 in the counter-feed direction. Rotation of drive shaft 138 in the counter-feed direction may occur, for example, when magazine 114 is decoupled from PTO gear 160. Back-ratchet 152 may be pivotally mounted on a shaft 170. Shaft 170 may be fixed to a magazine housing 128.

FIG. 7A is a perspective sectional view of another embodiment of a weapon system 210 with an ammunition magazine 214 in a position prior to engagement with a power take off 216 of a weapon 212. In this embodiment, the PTO coupling may be in the form of pin 60 and the magazine driver may be a Geneva mechanism 218. FIG. 7B shows ammunition magazine 214 after engagement of pin 60 and Geneva mechanism 218. FIG. 7C is an enlarged view of a portion of FIG. 7B showing the engagement of pin 60 and Geneva mechanism 218. PTO 216 may continuously rotate. The continuous rotary motion of PTO pin 60 may be transferred to Geneva mechanism 218. Geneva mechanism 218 may convert a continuous rotary input to a rotary output with intermittent dwell.

Figure 8A:
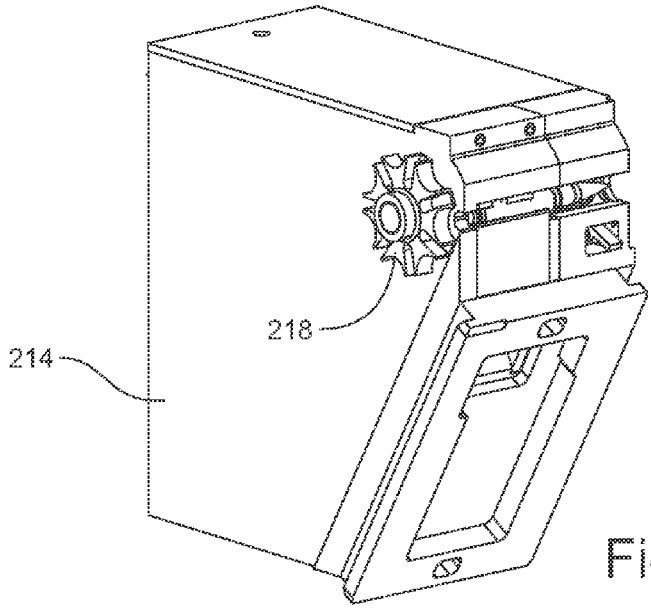
FIG. 8A is a perspective view of the magazine of FIG. 7A.
Figure 8B:
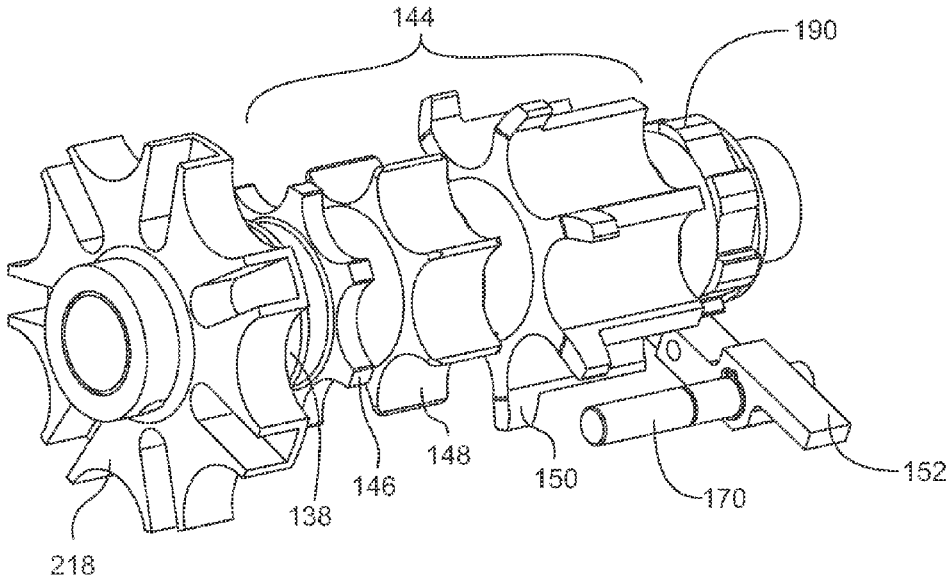
FIG. 8B is an enlarged view of the drive components of the magazine of FIG. 8A.

FIG. 8A is a perspective view of magazine 214 of FIG. 7A. FIG. 8B is an enlarged view of the drive components of magazine 214. Geneva mechanism 218 may be fixed to drive shaft 138. Drive shaft 138, drive sprocket 144, sprocket wheels 146-150, ratchet wheel 190, and back-ratchet 152 may be as described with reference to magazine 114.

The inventive linked ammunition magazine can be loaded and unloaded from a weapon remotely and automatically. The internal drive mechanisms of the magazines and the pick-off round opening enable the magazine to be robotically placed in and removed from an operating position with respect to a firearm. Human intervention to "start" an ammunition belt in the firearm is not required. The magazine may be partially depleted, removed from the weapon, and then reloaded in the weapon. Multiple magazines may be loaded and unloaded in any desired sequence. The capability to load multiple magazines, without human intervention, decreases the mass coupled to the weapon. The decreased mass coupled to the weapon facilitates faster and more accurate positioning and aiming of the weapon, improved stabilization performance and reduced overall power requirements. The capability to load multiple magazines also enhances mission flexibility. Individual magazines may store different types of ammunition, which may then be loaded to the weapon to suit the engagement.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An ammunition magazine for feeding linked ammunition to a weapon system having a power take off (PTO), the ammunition magazine comprising:

a housing that defines a storage cavity for the linked ammunition;

a drive shaft rotatably fixed to the housing and including a driver on one end for selectively engaging the PTO, the driver being disposed external to the housing;

a drive sprocket mounted on the drive shaft for engaging and moving the linked ammunition in a feed direction, the drive sprocket including first and second sprocket wheels that engage a cartridge portion of the linked ammunition;

a back-ratchet pivotally mounted to the housing, the back-ratchet selectively engaging the drive sprocket to prevent movement of the drive sprocket in a direction opposite the feed direction;

a pick-off round opening in the housing for presenting a pick-off round of the linked ammunition to the weapon system; and a link chute disposed below the opening and including an exit opening for ammunition links.

2. The magazine of claim 1, further comprising indentations formed on opposing edges of an external surface of the housing.

3. The magazine of claim 1, further comprising a retaining rod opening formed in one side of the housing.

4. The magazine of claim 1, further comprising a retainer disposed in the link chute for retaining empty ammunition links.

5. The magazine of claim 1, further comprising a pick-off round retainer disposed adjacent to the pick-off round opening.

6. The magazine of claim 1, wherein the drive sprocket is fixed to the drive shaft for rotation therewith.

7. The magazine of claim 1, wherein the drive sprocket is rotatably mounted on the drive shaft.

8. The magazine of claim 1, wherein the drive sprocket includes a third sprocket wheel that engages a link portion of the linked ammunition.

9. The magazine of claim 4, wherein the retainer includes a flap and a spring wherein the spring biases the flap into the link chute.

10. The magazine of claim 5, wherein the pick-off round retainer includes a leaf spring having one end fixed to the housing and another end for engaging the pick-off round.

11. The magazine of claim 6, wherein the drive sprocket includes a ratchet wheel, the back ratchet selectively engaging the ratchet wheel to prevent movement of the drive sprocket in a direction opposite the feed direction.

12. The magazine of claim 11, wherein the back-ratchet is biased towards the ratchet wheel.

13. The magazine of claim 12, wherein the driver provides rotary motion in a single direction.

14. The magazine of claim 13, wherein the driver provides intermittent dwell.

15. The magazine of claim 14, wherein the driver is a toothed gear.

16. The magazine of claim 14, wherein the driver is a Geneva mechanism.

17. The magazine of claim 7, wherein the driver provides oscillating rotary motion.

18. The magazine of claim 17, where the driver is a generally U-shaped hub having a slot therein.

19. The magazine of claim 17, wherein the drive sprocket includes a first ratchet plate fixed thereto, the magazine further comprising a second ratchet plate translatably disposed on the drive shaft adjacent to the first ratchet plate, the second ratchet plate being translatably biased towards the first ratchet plate and rotatable with the first ratchet plate in the feed direction.

20. The magazine of claim 19, wherein the first ratchet plate does not rotate with the second ratchet plate in the direction opposite the feed direction.

21. The magazine of claim 20, wherein the second sprocket wheel includes first and second sets of teeth and further wherein the first set of teeth extends radially further than the second set of teeth and the second set of teeth selectively engage the back-ratchet.

22. The magazine of claim 21, wherein teeth in the second set of teeth include respective rounded surfaces and flat surfaces, the rounded surfaces contacting the back-ratchet when the drive shaft rotates in the feed direction and the flat surfaces contacting the back-ratchet when the drive shaft rotates in the direction opposite the feed direction.

* * * * *